United States Patent [19]

Sharp

[11] Patent Number: 4,925,046

[45] Date of Patent: May 15, 1990

[54] DOUBLE WALLED RIBBED STORAGE TANK SYSTEMS

[76] Inventor: Bruce R. Sharp, 22375 Edgewater Dr. Unit 241, Charlotte Harbor, Fla. 33980

[21] Appl. No.: 308,463

[22] Filed: Feb. 10, 1989

Related U.S. Application Data

[63] Continuation-in-part of Ser. No. 290,361, Dec. 27, 1988.

[51] Int. Cl.[5] ..... B65D 25/00

[52] U.S. Cl. ..... 220/5 A; 220/469

[58] Field of Search ..... 220/5 A, 1 B, 410, 414, 220/469, 470, 72

[56] References Cited

U.S. PATENT DOCUMENTS

| | | | |
|---|---|---|---|
| 3,335,903 | 8/1967 | Anderson | 220/83 |
| 3,335,904 | 8/1967 | Anderson | 220/83 |
| 3,700,512 | 10/1972 | Pearson et al. | 156/62.4 |
| 3,848,765 | 11/1974 | Dürkop | 220/414 |
| 4,359,167 | 11/1982 | Fouss et al. | 220/5 A X |
| 4,561,292 | 12/1985 | Pugnale et al. | 73/49.2 |

*Primary Examiner*—Steven M. Pollard

*Attorney, Agent, or Firm*—Charles R. Wilson

[57] ABSTRACT

A method of making a storage tank system comprises forming an inner containment wall comprised of a series of wall sections onto the interior walls of a cylindrical-shaped ribbed storage tank. Each wall section is bonded to the tank's side walls at a distance of less than about four inches in height from the tank wall. Primary containment is provided by a tank formed of the wall sections and inner end caps. A monitored storage tank system with secondary containment is provided by the use of a leak detection means to monitor the space defined by the inner containment wall and the storage tank.

29 Claims, 2 Drawing Sheets

DOUBLE WALLED RIBBED STORAGE TANK SYSTEMS

This is a continuation-in-part of Ser. No. 07/290,361, filed Dec. 27, 1988, "Double Walled Storage Tanks Having A Ribbed Appearance".

This invention relates to double walled storage tank systems. More particularly, the invention relates to double walled underground storage tank systems wherein the outer wall is of a ribbed fibrous reinforced resinous construction.

BACKGROUND OF INVENTION

Underground storage tanks used primarily for the storage of gasoline are currently made of metal or a fibrous reinforced resinous material. The all metal tanks are cylindrical shaped, normally with flat end caps. The fibrous reinforced resinous tanks also are cylindrical shaped, with one tank variation having a ribbed appearance. The ribbed variation has a series of evenly spaced ribs extending circumferentially around the main body of the tank. The ribs significantly strengthen the tank. Additionally, they are able to absorb a certain degree of transport and installation external forces, which normally would have to be absorbed by the main body of the tank.

There are two methods which are widely used for building the ribbed fibrous reinforced resinous tanks. In one method, the main body of the tank is formed over a collapsible cylindrical shaped mold. Thus, a half mold having a smooth surface of proper shape has fibrous material and resinous material applied to its outer surface and cured. The basic wall forming components are applied separately or concurrently from separate spray guns. After proper curing, the mold is collapsed and removed. A second half tank is formed in a similar manner. The two half tanks are joined and secured together. A set of ribs are placed in desired locations on the exterior of the tank and adhered thereto by applications of fibrous and resinous materials.

A second method of building a ribbed fibrous reinforced resinous tank also uses a mold. However, in this method, the mold itself is shaped so that ribs are formed along with the rest of the main body. That is, the molds are provided with the mirror image of ribs. Fibrous material and resinous material are applied as in the first described method and ultimately cured.

Attempts have been made in recent years to build double walled steel and fibrous reinforced resinous tanks. Obvious methods have involved simply forming two tanks, one slightly smalled in diameter and length. The two properly dimensioned tanks are combined, normally with spacers, and used. Ribbed tanks having a double wall construction are not conducive to being formed in this manner.

There is a need for a double walled ribbed storage tank system. Such tank systems would have secondary containment capability because of the double wall construction. Such systems would also have the strength characteristics resulting from the rib feature. The problem has been how to build such a tank system in an efficient manner. There has now been discovered a method of building double walled ribbed storage tank systems using a unique sequence of construction steps. The method is efficient in terms of labor savings and raw material savings. The method is also attractive in that fumes normally given off in any process using resinous materials are confined and thus readily controlled.

SUMMARY OF THE INVENTION

A ribbed storage tank made of fibrous reinforced resinous material is given secondary containment capability by forming a tank within its interior. A series of wall sections are applied to the ribbed tank's interior surfaces in an overlapping manner. Each wall section is spaced from the underlying ribbed storage tank. In a preferred embodiment of the invention, anchor wall sections are attached at their edges to interior side walls of the tank's rib portions. Each of these anchor wall sections have bridging wall sections attached thereto which cover the ribbed areas and tie all the wall sections together to form a continuous interior wall.

DETAIL DESCRIPTION OF THE INVENTION

The invention is described with reference to the drawings and with reference to underground storage tanks for use in retail gasoline service stations in particular. The storage tank systems of the invention have use in the above ground storage of other liquids as well. It is to be understood such uses are contemplated.

Figure 1:
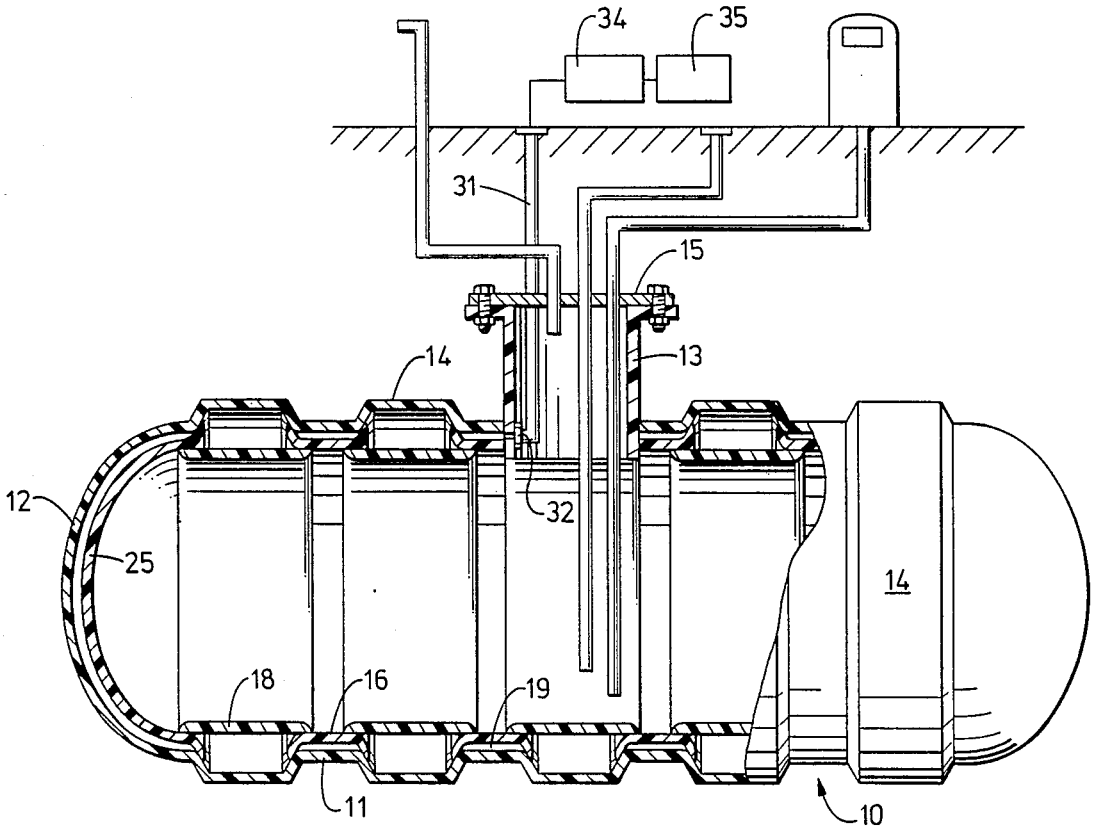
FIG. 1 is a side view in section of a double walled ribbed storage system of this invention.

With reference to FIG. 1, there is shown a double walled ribbed storage tank system. The outer tank 10 of the type shown in FIG. 1 is commercially produced, especially for use in the gasoline service station industry. Such tanks comprise a main cylindrical-shaped body 11, end walls 12, and manway 13. Main body 11 and end walls 12 are made of fibrous reinforced resinous material. Ribs 14 are an integral part of main body 11. Not illustrated but within the spirit of this invention are those tanks wherein the end walls are flat and those tanks not having manways.

Storage tank 10 forming a part of this invention is formed in a conventional fashion. A cylindrical-shaped mold in the form of a lateral half of the storage tank is provided with contoured sides in the form of ribs. The ribs extend circumferentially around the mold. A half tank is initially made by applying a fibrous material and a resinous material. Fibrous materials made of fiberglass, nylon, and other synthetic materials are in the form of mattings, nets, screens, meshes, continuous strands and chopped strands. The form of the fibrous material is dictated by the mode of production. Resinous materials include the polyesters, e.g. vinylester and isophthalic polyesters, polyurethanes and polyepoxides. Other fibrous and resinous materials are used, it being understood the aforementioned materials are only exemplary of the materials which can be used.

The manner of forming the cylindrical shaped main body with the fibrous and resinous materials is based on one of at least three known techniques. A preferred technique utilizes a two-head spray gun to spray separate streams of chopped fibrous material and liquid resinous material onto the mold. The spray applications are controlled to form a desired thickness of materials which are dried of solvent and cured. If needed, a series of spray applications is used to build the wall's thickness until eventually a wall of proper strength is obtained. Alternatively, sheets of fibrous material is laid onto the mold and resinous material sprayed thereon. Sufficient resin is sprayed to normally saturate the fibrous sheet or at least penetrate the sheet's surface to form a continuance solid outer surface. The resin is subsequently cured. Still another known techniques used to build storage tanks of the type used in their invention is to apply filament windings of fibrous strands around the tank mold. The strands are saturated with liquid resin at the time of winding or the liquid resin is applied shortly thereafter and cured. In all techniques, an end cap is formed at the same time as the main walls and in the same manner or alternatively is formed separately and attached to the main cylindrical-shaped wall.

In all the above described manners of building the outer tank 10, the mold on which the fibrous reinforced resinous material tank is formed is collapsed and removed. Next, another lateral tank half formed in the same manner is abutted against the first lateral tank half and securely joined. The resultant full tank is a single walled structure. Ribs formed as a part of its making add structural strength to the tank to withstand external forces encountered during use. The ribs are characterized in being hollow and open to the tank's interior.

A sufficient number of openings are either formed or added to storage tank 10. The openings are to accommodate various access lines to the interior of the tank. For instance, a fill pipe, dispensing line and vent pipe can enter the storage tank at various points in the tank's surface, but preferably all enter through cover 15 of manway 13.

In accord with this invention, initially a series of spaced anchor wall sections 16 are formed inside the storage tank 10. As used throughout, anchor wall sections is defined to mean the wall sections are bounded or anchored directly to an interior wall of storage tank 10. The anchor wall sections extend circumferentially around the interior wall of the storage tank. Each section is attached at least partially along both its edges to the tank. The mid portions of the sections between the edges are not attached to the tank so that an open space exists under each wall section. The sections extend less than about four inches in height from the tank wall, preferably from about 1/64 inch to about ¼ inch. Portions of the anchor wall sections may contact the tank wall 10 and, in fact, is preferred. Such contact is not detrimental to the storage tank system's performance provided the two walls remain at least partially separated i.e. they are not sealed together.

The width of an anchor wall section 16 ranges from about eight inches to about thirty inches. For purposes of illustration only, the ribs 14 and consequently wall sections in FIG. 1 appear larger than are normally encountered. The preferred width of a section is from about twelve inches to about twenty inches. About two to six inches, preferably about three to about five inches separate the individual anchor wall sections. The preferred wall section widths and spacing varies based on structural design and size of the tank. The aforementioned preferred widths are for a storage tank having a diameter of from about four feet to about twelve feet.

Figure 2:
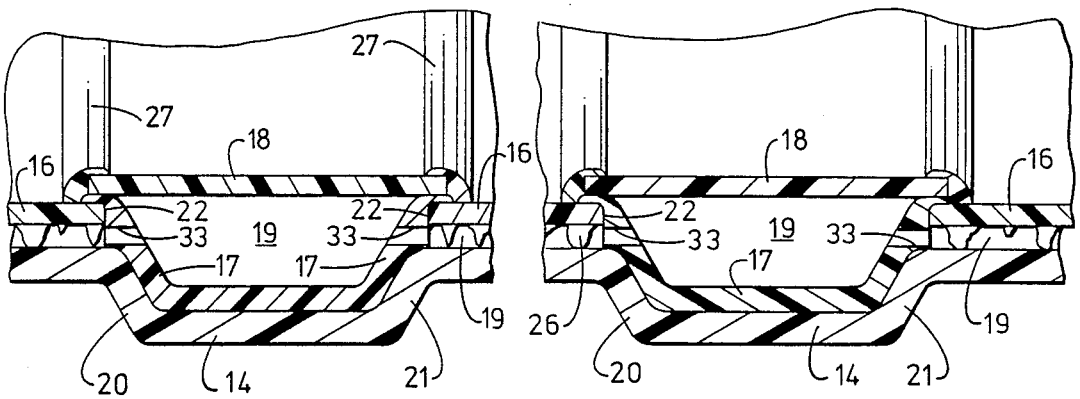
FIG. 2 is an enlarged side view in section showing in detail the wall area of the storage tank system of FIG. 1.

The bonding technique used to secure wall sections 16 to the side walls of storage tank 10 will depend on the materials of construction of the anchor wall sections, per se. Adhesive and caulking can be used. Preferably, as best seen in FIG. 2 the wall sections are made of fibrous reinforced resinous material and the bonding is accomplished using an overlay 17 of the same material. The overlays 17 can, though need not must, cover the inner rib areas between the anchor wall sections as shown.

Bridging wall sections 18 are attached at their edges to adjoining anchor wall sections 16. They are attached using a bonding technique as above described. The sections 18 cover the hollow rib area between adjacent anchor wall sections 16. In effect, they bridge over the space between the anchor wall sections.

As evident from FIG. 2, the anchor wall sections 16 and bridging wall sections 18 are applied in a fashion so that collectively they cover the interior walls of cylindrical-shaped main body 11. The bridging wall sections are bonded along their entire side edges to the anchor wall sections. A liquid tight wall is formed.

The points of attachment of anchor wall sections 16 to the interior wall of the tank 10 and to the bridging wall sections 18 is shown in the preferred arrangement depicted in FIG. 2. Wall sections 16 laterally extend from one rib side wall 20 to an adjacent rib side wall 21. Edges 22 of the anchor wall sections are bonded to a side wall of the ribs by the overlay 17. Thereafter, bridging wall sections 18 are positioned to cover the hollow rib area and are attached to adjacent anchor wall sections. Attachment of the wall sections to the side walls of the rib enhances the strength of the ribs and hence the composite strength of the double walled storage tank.

Inner end caps 25 may be preformed, preferably of fiberglass reinforced resinous material and positioned over the tank's end walls. A space between the end caps and end walls is provided to receive leaked liquid. As shown in FIG. 1, the inner end cap 25 is attached to the side wall of the storage tank 10. A bridging wall section 18 is bonded to the inner end cap. In all embodiments, the spaced anchor wall sections, bridging wall sections and inner end caps are secured together in a sealed or liquid-tight fashion to collectively form a container. The areas 19 under the anchor and bridging wall sections and the inner end caps provide an annular containment area for receiving stored liquid which may leak through the inner walls or ground liquid which may seep through the storage tank walls 10.

One method of forming the anchor wall sections 16 and bridging wall sections 18 depicted in FIGS. 1 and 2 is to initially place solid sheet material around the inner surface of the tank's cylinder-shaped body. Examples of such sheets include metal sheets and/or fiberglass/resin sheets. The metal sheet can be a thin gauge steel sheet, preferably with a diamond grid pattern on the surface which faces the inner wall of the tank 10. The fiberglass resin sheet preferably has a stucco appearance on the side facing the tank. As shown, surface irregularities 26 extend in a random fashion from wall sections 16. It is preferred that the solid sheet material has an irregular surface on at least one side to ensure a seal is not formed by its contact with the tank walls. The fibrous reinforced resinous overlay 17 is next applied over the edges of the anchor wall sections. Bridging wall sections 18 are then properly positioned and additional overlay material 27 applied substantially over them so as to secure each bridging wall section to an anchor wall sections.

During installation of the wall sections, it is preferred that a slight vacuum be maintained in the interior. In one embodiment, a storage tank lateral half is built and then the anchor and bridging wall sections added. In another embodiment the storage tank lateral halves are built, joined to form a full tank, and then the anchor and bridging wall sections added. Conveniently, the manway 13 in this second embodiment is sealed and a vacuum drawn through it to remove solvents and other fumes generated by the process. In either embodiment, the fumes are confined. As such, health concerns to workers is reduced.

Figure 3:
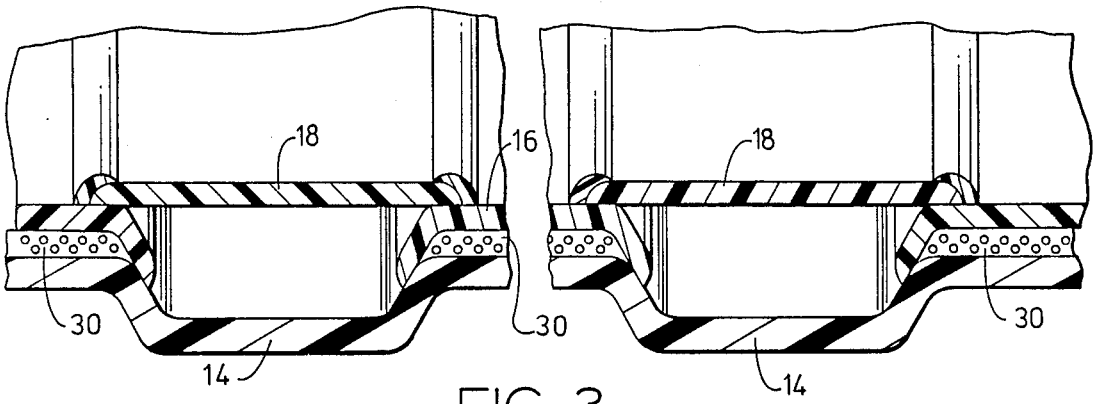
FIG. 3 is a side view in section showing a wall section as in FIG. 2, though with the addition of separating material.

When needed, a separating material having an at least partially impervious outer planar surface is applied in spaced sections to the surface area on the tank's inner surface, including the inner surface of the outer end caps. The purpose of the separating material is to ensure that the subsequently applied fibrous reinforcing material and resinous material which form the wall sections and inner end caps will not seal to the interior wall of storage tank 10. FIG. 3 illustrates this aspect of the invention.

Separating materials include solid polymeric films, corrugated sheets, irregular surfaced sheets, and foraminous or porous materials which are sealed on at least one side. Many pliable or semi-rigid materials are usable. Examples of such material are polyethylene, jute, polyurethane foam, polyester foam, polyether foam, fiberglass matting, cotton matting, nylon matting, corrugated cardboard, steel sheets with an irregular surface, fiberglass resinous sheets with an irregular surface, and asbestos which range from about 0.01 inches to almost 1.0 inch in thickness. A heat seal or sealing material, e.g. a polymeric coating, or a impervious wrapping such as polyethylene sheeting is used on one surface of any foraminous materials when needed to prevent substantial saturation with subsequently applied resinous material.

The minimum thickness of the separating material must be sufficient to prevent the subsequently applied wall section from adhering to the storage tank. Accordingly, any shrinkage resulting from formation of the wall section must be accounted for by having a sealed material thick enough to be partially collapsed, but not form a compression seal between the walls. In FIG. 3, separating material 30 is an open cell foam.

Subsequent placement of wall sections, use of overlaps, and attachments of inner end caps as described with reference to FIGS. 1–2 is next done. The resultant inner containment wall is a fibrous reinforced resinous material comprised of wall sections and end caps. Its strength and integrity are sufficient that it is capable of being the primary containment facility for building gasoline.

With further reference to FIG. 1 there is shown a storage tank 10 of the type described in FIG. 1 wherein the open spaces between the formed inner tank and outer tank walls are monitored. An access tube 31 extends from ground level through manway lid 15 and access hole 32 so as to be in communication with the open spaces. Preferably, the spaces enclosed by the wall sections 16 and 18 and the inner end caps 25 are in communication. This is accomplished in one method by laying at least one apertured tube along the length of the tank 10 prior to forming the wall sections thereon. Subsequent steps of securing the sections to the tank, and forming the inner containment wall are done in a fashion above described. Preferably, at least two aperture tubes are used with one being positioned along the bottom of the tank and one along the top of the tank. Alternatively, a tube or rod is used in place of the apertured tube and removed after the final wall section is formed. Vacuum can be used to collapse the walls of the tube to facilitate its removal. The result being a tank system with a tunnel 33 extending the length of the inner tank's outside surface. Still other ways can be used to provide communication throughout the enclosed areas. Additionally, the access tube can lead from ground level directly through tank 10's wall to the annular space.

Any of well known and commercially available monitor means are used for monitoring the spaces between walls. For example, the space can be placed either under a non-atmospheric pressure, i.e. a positive or negative air pressure. Detection means associated with the closed space is capable of detecting any change in pressure resulting from a leak in the overlay or the storage tank. As shown in FIG. 1, there is provided a means for maintaining the space under a negative pressure. Conventional vacuum pump 34, together with an associated pressure regulator can be used. A pressure change sensor 35 is a part of the detection means. A pressure gauge serves this purpose adequately. Optionally, an alarm system can be electronically linked with the pressure sensor to audibly or visually warn of a preset significant pressure change. A vacuum is preferred because of a resultant increased composite strength of the storage tank system by drawing the inner and outer walls together.

Another embodiment of the detection means utilizes an analyzer capable of detecting the liquid being stored. Thus, the detection means comprises the analyzer which is communication with the annular space. Preferably, a vacuum means for withdrawing gaseous material from the space is used for the purpose of obtaining a sample. Thus, in FIG. 1, element 35 is an analyzer capable of detecting selected liquids instead of a pressure change sensor.

Still another detection means utilizes a probe which extends through the access tube so as to monitor for leakage at or near the bottom of the annular space. The probe is capable of detecting preselected liquids or gases. In this embodiment, leakage will ultimately seep to the bottom of the annular space and be detected. Detecting liquid can also be used as part of a detection means. Thus, a non-polluting liquid is used to fill the annular spaces and an access tube is installed leading to ground level. A sight glass at the access tube's end allows a visual observation of any change in detecting liquid level.

All the leak detection means discussed above can be electronically linked with an alarm system to audibly or visually warn of a pre-set significant change in the closed annular spaces. The leak detection means and secondary containment means allow for an early warning of a deterioration of either the primary or secondary containment means thereby permitting the necessary repair work to be done before any significant soil or water contamination has occurred.

Figure 4:
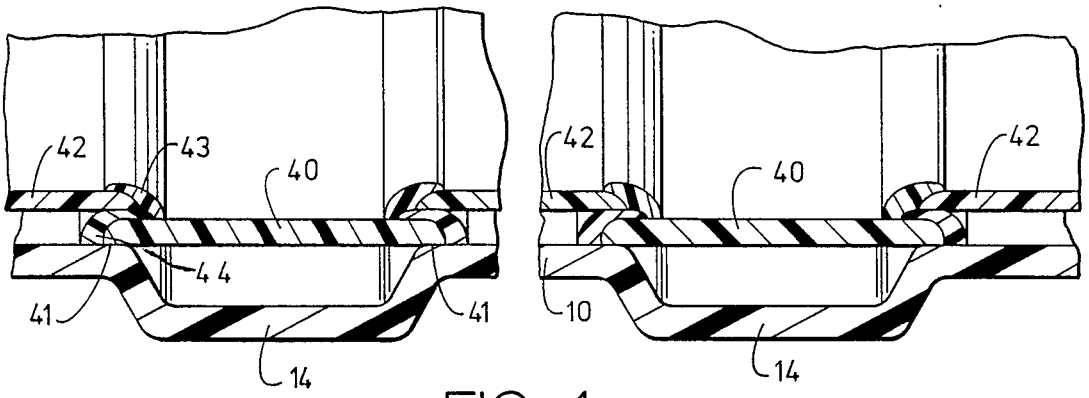
FIG. 4 is another side view in section showing a wall section in detail of another storage tank system of this invention.
Figure 5:
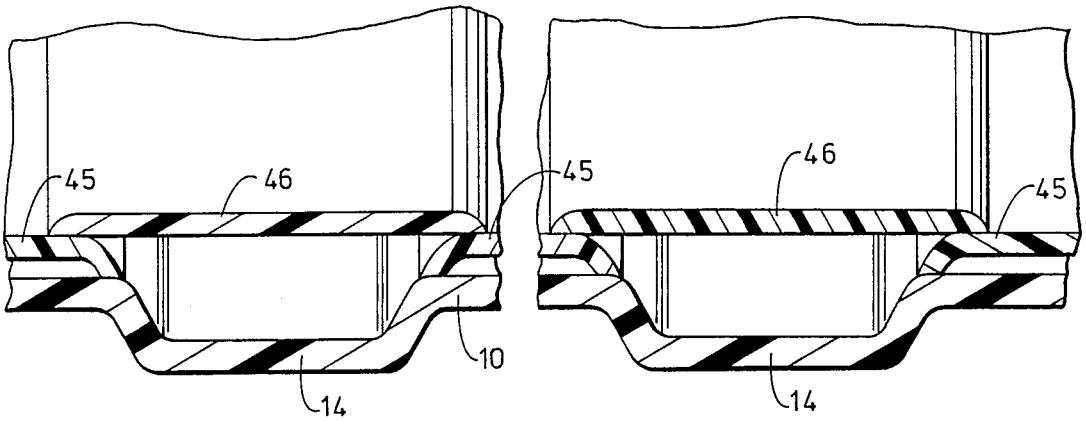
FIG. 5 is still another embodiment of this invention showing a side view in section of another interior wall construction.

FIGS. 4 and 5 illustrate alternative points of attachment for the anchor wall sections and the bridging wall sections. In FIG. 4, anchor wall sections 40 are positioned so that they cover the recessed rib areas and are attached to the tank wall 10 at main wall areas 41, near the rib recess. Bridging wall sections 42 cover the main wall area of the tank wall 10 and are attached to adjacent anchor wall sections 40. Overlays 43 and 44 are used for the attachment purposes.

In FIG. 5, anchor wall sections 45 are attached at each side edge to a main wall area of tank wall 10. Bridging wall sections 46 cover the recessed rib areas and are attached to adjacent anchor wall sections 45.

Materials of construction of the wall sections of FIGS. 4 and 5 are the same as discussed above with reference to FIGS. 1 and 2. Manners of attachment are also the same as are the provisions for inner end caps.

While the invention has been described with respect to preferred embodiments, it is understood that various modifications may be made without departing from the spirit of the subject invention as defined by the appended claims. All obvious variations are within the scope of the claims.

What is claimed is:

1. A method of building a double walled ribbed storage tank system from a cylindrical-shaped tank formed of a fibrous reinforced resinous material, said cylindrical-shaped tank made in a fashion wherein a set of spaced exterior protruding ribs extend circumferentially around the tank and wherein each of the rib's interiors is open to the tank's interior, further said tank's interior wall being generally contoured with rib recesses, comprising the steps of:

(a) attaching to interior walls of the cylindrical-shaped tank a series of anchor wall sections spaced laterally and circumferentially around the tank's interior wall and separated at least in a mid portion from the interior wall;

(b) attaching a series of bridging wall sections to the anchor wall sections so that each bridging wall section is attached at each edge to an anchor wall section so as to form a continuous wall along the tank's interior; and (c) attaching an inner end cap to a wall section at each end of the tank in a manner such that the anchor wall sections, bridging wall sections and inner end caps are bonded together to collectively form a container capable of holding a liquid.

2. The method of claim 1 wherein each anchor wall section covers an area of the tank wall between adjacent ribs and the bridging wall sections cover the rib recesses.

3. The method of claim 2 wherein each anchor wall section is attached at its edges to side walls of the recessed rib so as to strengthen said rib against external load forces.

4. The method of claim 1 wherein each edge of each anchor wall section is attached to adjacent areas of the tank wall separated by the recessed rib so as to cover said recessed rib.

5. The method of claim 1 wherein each anchor wall section is attached at each of its edges to a wall area between two recessed ribs so as to substantially cover said wall area and the bridging wall sections are attached to adjacent anchor wall sections so as to cover a recessed rib area.

6. The method of claim 1 wherein the anchor wall sections are formed at a distance less than about four inches in height from the interior wall of the cylindrical-shaped tank.

7. The method of claim 6 wherein each anchor wall section is formed substantially in contact with the tank wall, yet not sealed thereto in a liquid tight fashion.

8. The method of claim 1 wherein each anchor wall section is from about eight inches to about thirty inches in width.

9. The method of claim 8 wherein each anchor wall section is from about twelve inches to about twenty inches wide.

10. The method of claim 1 wherein the anchor wall sections and bridging wall sections are formed of a fibrous reinforced resinous material.

11. The method of claim 10 further comprising the step of placing a separating material on the interior side of the tank walls at least where the anchor wall sections are to be formed, thereby providing a means whereby the mid sections of the anchor wall sections remain structurally independent of the tank.

12. The method of claim 11 wherein the separating material is sealed on at least one side to prevent substantial migration of resinous material therethrough to reach the tank wall.

13. The method of claim 12 wherein the separating material is a foam, matting, net, screen or mesh and a surface nearest the anchor wall section is sealed.

14. The method of claim 1 wherein areas under the anchor wall sections and bridging wall sections are provided with access openings for communication to allow monitoring of the space between the formed wall sections and tank to detect leakage.

15. The method of claim 1 wherein the wall sections are formed from solid sheet materials.

16. A double walled ribbed storage tank system, comprising (a) a fibrous reinforced resinous outer tank having a set of exterior protruding ribs extending circumferentially around the tank wherein the interior of each of the ribs is hollow; and (b) an inner tank comprised of a series of anchor wall sections spaced laterally and circumferentially around the outer tank's interior wall and separated at least in a mid portion from the outer tank's wall, bridging wall sections attached at each edge to an anchor wall section, and inner end caps at each end, further wherein the anchor wall sections, bridging wall sections and inner end caps are bonded together to form an inner tank, said inner tank capable of storing liquid and said outer tank being a secondary containment means for leaked liquid.

17. The double walled ribbed storage tank system of claim 16 wherein each anchor wall section covers an area of the tank between adjacent ribs and the bridging wall sections cover the rib recesses.

18. The double walled ribbed storage tank system of claim 17 wherein each anchor wall section is attached at its edges to side walls of the recessed rib so as to strengthen said rib against external load forces.

19. The double walled ribbed storage tank of claim 16 wherein each edge of each anchor wall section is attached to adjacent areas of the tank wall separated by a recessed rib so as to cover said recessed rib.

20. The double walled ribbed storage tank system of claim 16 wherein each anchor wall section is attached at each of its edges to a wall area between two recessed ribs so as to substantially cover said wall area and the bridging wall sections are attached to adjacent anchor wall sections so as to cover a recessed rib area.

21. The double walled ribbed storage tank system of claim 16 wherein the anchor wall sections are formed at a distance less than about four inches in height from the interior wall of the outer tank.

22. The double walled ribbed storage tank system of claim 21 wherein each anchor wall section is formed substantially in contact with the tank wall, yet not sealed thereto in a liquid tight fashion.

23. The double walled ribbed storage tank system of claim 16 wherein each anchor wall section is from about eight inches to about thirty inches in width.

24. The double walled ribbed storage tank system of claim 23 wherein each anchor wall section is from about twelve inches to about twenty inches wide.

25. The double walled ribbed storage tank system of claim 16 wherein the anchor wall sections and bridging wall sections are formed of a fibrous reinforced resinous material.

26. The double walled ribbed storage tank system of claim 25 further comprising a separating material on the interior side of the tank walls under at least the anchor wall sections to provide a means whereby the mid sections of the anchor wall sections remain structurally independent of the tank.

27. The double walled ribbed storage tank system of claim 26 wherein the separating material is sealed on at least one side.

28. The double walled ribbed storage tank system of claim 27 wherein the separating material is a foam, matting, net, screen or mesh and a surface nearest the anchor wall section is sealed.

29. The double walled ribbed storage tank system of claim 16 wherein areas under the anchor wall sections and bridging wall sections are provided with access openings for communication to allow monitoring of the space between the outer tank and inner tank to detect leakage.

* * * * *